US005634573A

United States Patent [19]

Steinberg et al.

[11] Patent Number: 5,634,573

[45] Date of Patent: Jun. 3, 1997

[54] DISPENSING SYSTEM AND METHOD FOR VISCOUS MATERIALS

[76] Inventors: Joel Steinberg; Faye Steinberg, both of 530 N. Oaktree La., A, Thousand Oaks, Calif. 91361

[21] Appl. No.: 509,188

[22] Filed: Jul. 31, 1995

[51] Int. Cl.[6] ..... B67D 5/06

[52] U.S. Cl. ..... 222/179.5

[58] Field of Search ..... 141/364, 375; 222/105, 154, 173, 183, 184, 185.1, 179.5; 143/319, 320, 343; 248/146, 148

[56] References Cited

U.S. PATENT DOCUMENTS

| | | | |
|---|---|---|---|
| 3,866,803 | 2/1975 | Kipfmueller | 222/179.5 |
| 4,271,878 | 6/1981 | Bologa | 141/375 |
| 4,454,897 | 6/1984 | Valiant | 141/364 |
| 5,146,957 | 9/1992 | Belokin, Jr. et al. | 222/179.5 |
| 5,149,041 | 9/1992 | Hartke | 248/146 |
| 5,460,298 | 10/1995 | DiBiase et al. | 222/173 |

*Primary Examiner*—Philippe Derakshani
*Attorney, Agent, or Firm*—Koppel & Jacobs

[57] ABSTRACT

A device for storing tapered containers in an inverted position, so as to cause viscous material inside the containers to settle at the container's dispensing end, comprises a sleeve that is shaped so that it will fit over the container in a form-fitting fashion during non-use. In use, the sleeve is removed from the container and its bottom is placed on a supporting surface. The container is inverted and its dispensing end is inserted into the sleeve's top opening. The container is stored in this inverted position so as to allow its contents to flow to its dispensing end, where it is immediately available for dispensing without having to shake the container. The form-fitting feature allows the sleeve to be sold and shipped with its associated container as one unit without a significant increase in the overall bulk.

7 Claims, 3 Drawing Sheets

DISPENSING SYSTEM AND METHOD FOR VISCOUS MATERIALS

BACKGROUND OF THE INVENTION

1. Field of the Invention

The present invention relates to containers for storing viscous materials. More specifically, it relates to a device for supporting tapered containers in an inverted position so as to cause viscous material inside the container to settle to its dispensing end.

2. Description of the Related Art

Viscous material that is sold and stored in containers, such as ketchup or mustard, tends to settle to the bottom of the container during shipping and storage. This can make it difficult to dispense the material through an opening at the upper end of the container. Such containers typically have a relatively wide support base on the bottom, and a narrower upper dispensing end. They are stored upright on a refrigerator or pantry shelf, and must be inverted in use to dispense their contents. Often the consumer must vigorously shake the container in an inverted position to transfer the contents to the dispensing end. This often results in spillage or over dispensing. As the level of the viscous material in the container goes down due to consumption, it becomes progressively more difficult to transfer the remaining material that settles to the bottom of the container to the dispensing end.

Various devices have been proposed for draining viscous foods or other materials from a container, or for transferring the material from one container to another. One device, described in U.S. Pat. No. 4,271,878 by Bologa, consists of a structure for supporting a ketchup bottle in an inverted position and a container that is placed underneath the mouth of the bottle to receive the ketchup that is drained out. The supporting structure has an opening for receiving the neck of the bottle, with flexible fingers extending into the opening. The flexible fingers engage the neck of the bottle and support it. Bottles of various sizes can be accommodated due to the resilient nature of the fingers.

A problem with this device is that it cannot be sold and shipped together with a bottle as one unit without a significant increase in overall bulk. In addition, the resiliency of the flexible fingers that are used to support the bottle may degrade over time, resulting in a decrease in the supporting force that the fingers apply to the bottle. This may be particularly problematic if the device is used to support a small bottle after large bottles have been supported for long periods of time. This is because the fingers in the opening have to flex by a greater amount to accommodate the larger bottles. If the resiliency of the fingers degrade, the supporting force applied to the smaller bottle may not be sufficient to keep it from falling through the opening. Also, there is still a need to invert the bottle after storage and the possibility of having to shake it to move the contents down and start the flow.

A device for supporting a bottle of effervescent liquid in an inverted position is described in U.S. Pat. No. 5,149,041 by Hartke. It is intended to be used only after the bottle has been opened and recapped, to prevent the effervescent gases from escaping through the cap. This device, like the Bologa device, adds significantly to the overall bulk of the container. It uses four large vertical supports that allow multiple containers and their respective supports to be stacked. A device for transferring the contents of one bottle to another is described in U.S. Pat. No. 4,454,897 by Valiant. This device consists of a flat sheet of flexible material that is wrapped around two food containers to hold them in a mouth-to-mouth relationship, with the bottle that is being drained held in an inverted position and the receiving bottle held in an upright position. Although this device holds one of the containers in an inverted position, it is in combination with a second upright container. The device does not provide adequate support for holding a single container in an inverted position and cannot be used for storage, since the two bottles, when stacked vertically, are higher than the typical refrigerator or pantry shelf clearance. In addition, the process of wrapping the two bottles together with the flat sheet of material is time consuming and inconvenient.

U.S. Pat. No. 5,146,957 discloses a combination oil container holder and drainer that is designed to hold an oil container in an inverted position in order to drain the residual oil in it. The combination holder/drainer consists of a reservoir with an opening that is shaped to hold the oil container in an inverted position. Since the device is designed to be both a holder and reservoir, it is very large and bulky. It is not intended to be used for storage, and oil does not have the dispensing problems of thicker substances like ketchup or mustard.

SUMMARY OF THE INVENTION

In view of the above problems, the present invention provides a device for storing a tapered container in an inverted position, so as to cause viscous material inside the container to settle to its dispensing end, where it is immediately available for dispensing without having to shake it down. The device is designed so that it may be sold and shipped with its associated container as one unit without a significant increase in bulk, while still providing stable support for the inverted container during use.

The device comprises a sleeve with a top opening that is narrower than the widest portion of the tapered food container that it is designed to support. In use, the bottom portion of the sleeve is placed on a support surface, while the dispensing end of the container is inserted into the top sleeve opening. Because the container is tapered, with a portion that is wider then the top sleeve opening, the container is supported in an inverted position by the sleeve. The sleeve is shaped so that it will fit over the container in a form-fitting fashion during non-use. The form-fitting feature allows the device to be sold and shipped with its associated food container as one unit without a significant increase in the bulk of the container.

In a preferred embodiment, the height of the sleeve is such that the dispensing end of the inverted container is held above the supporting surface. In addition, the size of the bottom portion of the sleeve and the size of the widest portion of the container are preferably approximately equal in order to provide a more stable base for the sleeve in its in-use position.

These and other features and advantages of the invention will be apparent to those skilled in the art from the following detailed description of preferred embodiments, taken together with the accompanying drawings, in which:

DETAILED DESCRIPTION OF THE INVENTION

Figure 1:
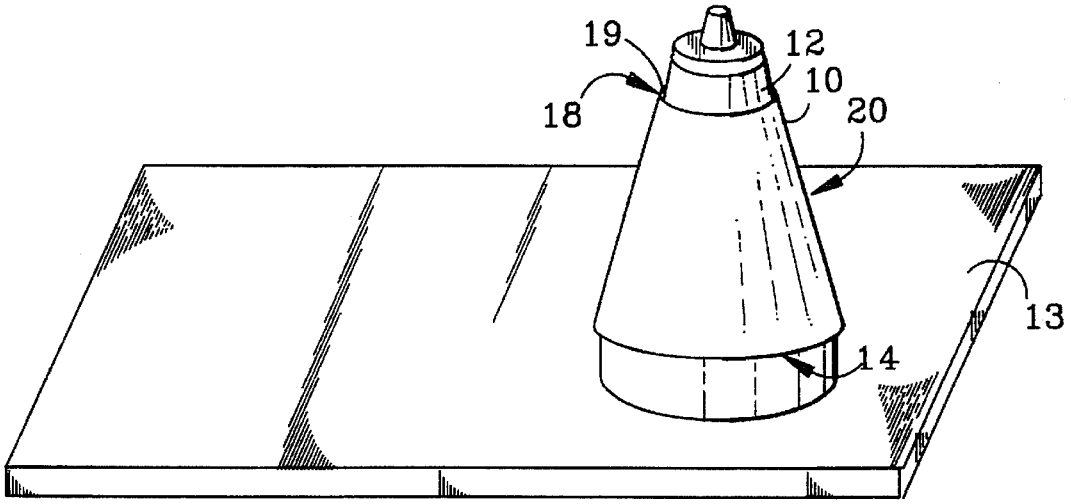
FIG. 1 is perspective view illustrating the present device and its associated container in a non-use or shipping configuration.

FIG. 1 illustrates the present device and its associated container in a non-use or shipping configuration. The device consists of a sleeve 10 that is shaped and sized to fit over a tapered container 12, such as a ketchup or mustard dispensing container, in a form-fitting fashion. The sleeve 10 comprises a bottom portion 14, a top portion 18 with an opening 19, and a middle portion 20 connecting the top and bottom portions. The sleeve 10 and container 12 are shown on a supporting surface 13, such as a shelf. The form-fitting feature allows the sleeve 10 to be sold and shipped with its associated container 12 without a significant increase in the bulk of the container 12. Thus, the sleeve 10 and container 12, in their shipping configuration, do not take up any more shelf 13 space than the container 12 would alone.

The sleeve 10 is preferably sized so that its bottom extends to the widest part of the container 12. This provides greater stability for the sleeve 10 and container 12 when the container 12 is supported in an inverted position, as will be explained in more detail below. The sleeve 10 is preferably made of the same material as the container For example, if the container 12 is made of plastic of a predetermined thickness, the sleeve 10 would preferably be made of the same type of plastic. The use of common materials for the sleeve 10 and container 12, combined with the fact that the form-fitting sleeve 10 has a shape that is substantially the same as that of its associated container 12, allows a manufacturer to fabricate both the container 12 and associated sleeve 10 with common production facilities. If an optically transparent material, such as plastic, is used for the sleeve 10, product labels that may be affixed to the container 12 will be visible to the consumer through the sleeve 10. However, the manufacturer may also attach a separate product label to the sleeve 10.

Figure 2A:
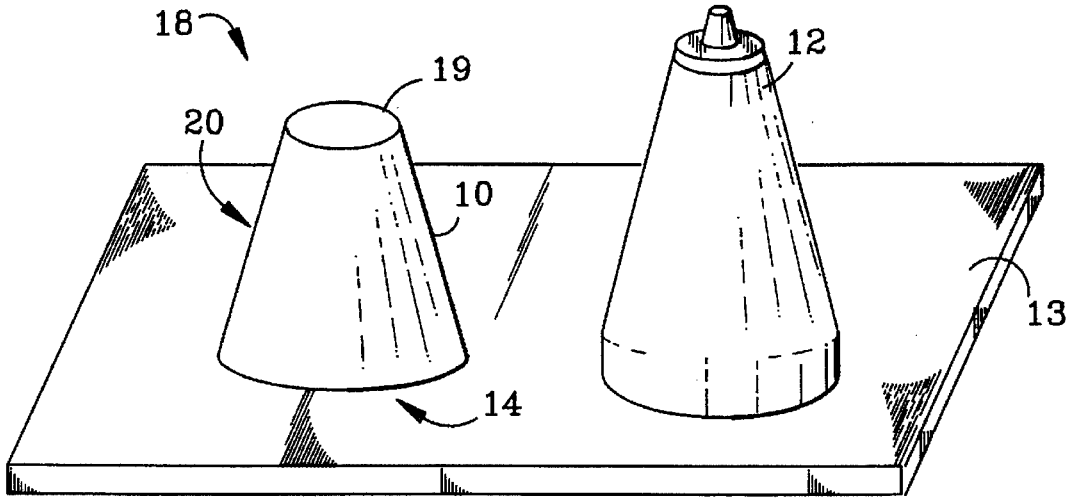
FIGS. 2*a*–2*c* are perspective views illustrating how the device is used to support its associated container in an inverted position.
Figure 2B:
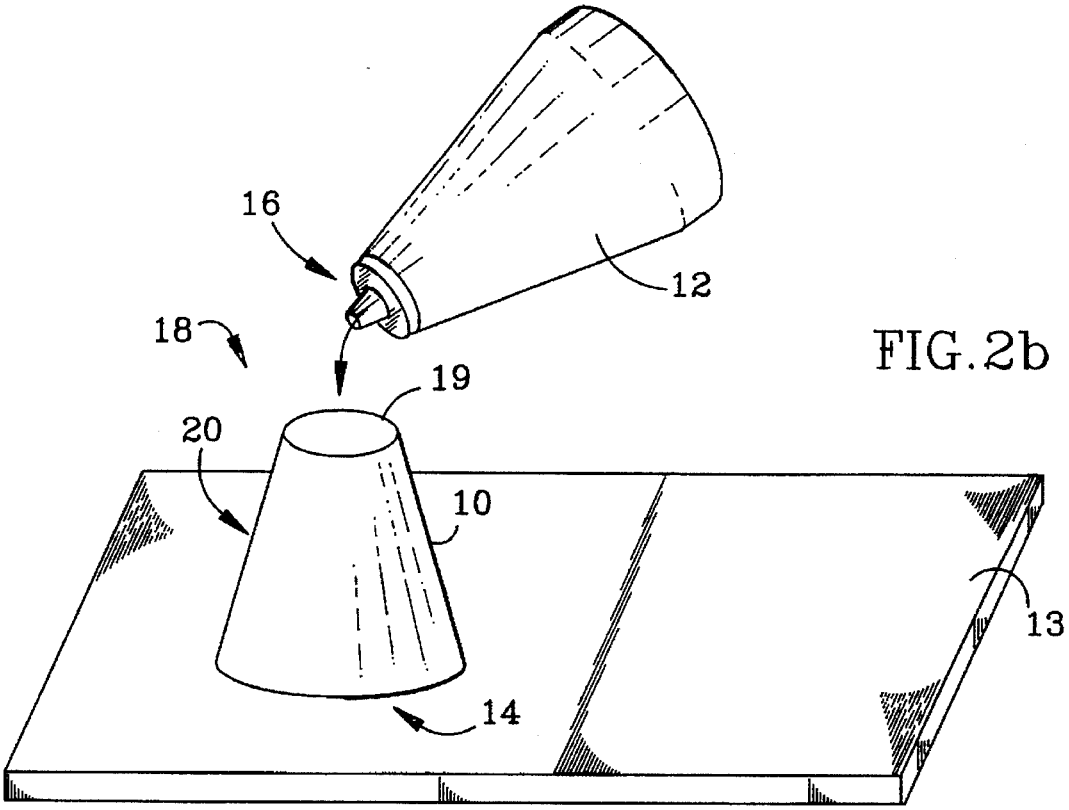
Figure 2C:
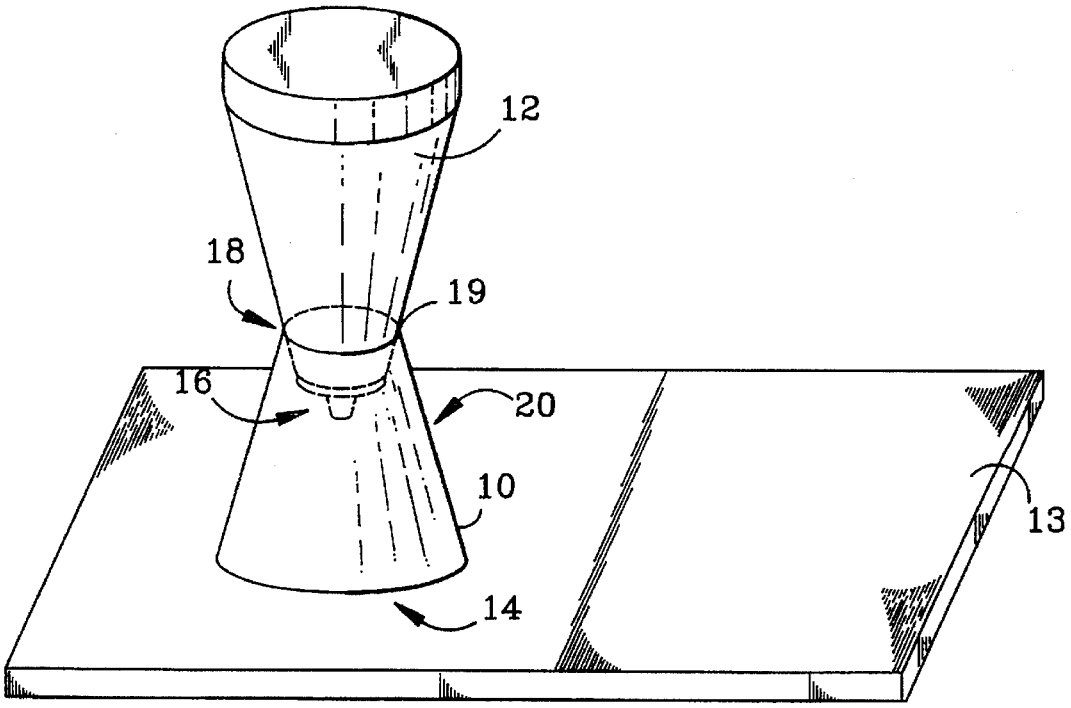

FIGS. 2*a*–2*c* illustrate how the sleeve 10 is used to support the container 12 in an inverted position. In FIG. 2*a*, the sleeve 10 is slipped off the container 12 and positioned with its bottom portion 14 on support surface 13. FIGS. 2*b* and 2*c* illustrate how the container 12 is placed in the sleeve 10. The container 12 is inverted and its dispensing end 16 is inserted into the top opening 18 of sleeve 10. The container's final resting position is shown in FIG. 2*c*.

Figure 3C:
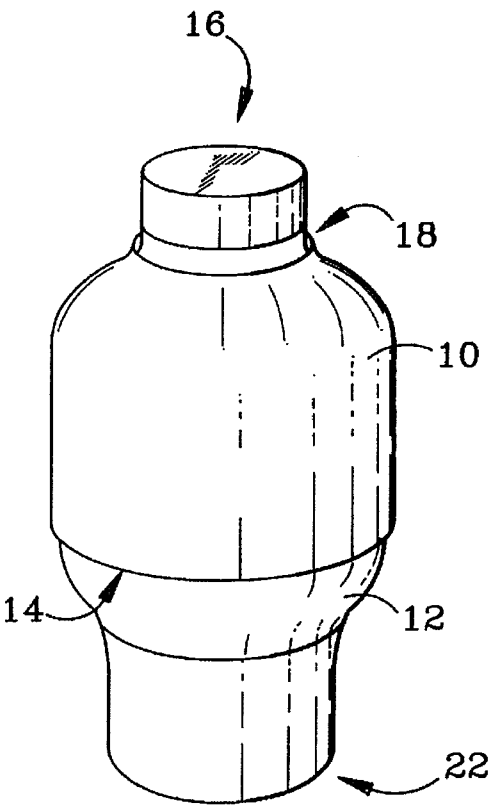
FIGS. 3*a*–3*c* are perspective views of the present device with associated containers of differing shapes and sizes.
Figure 3B:
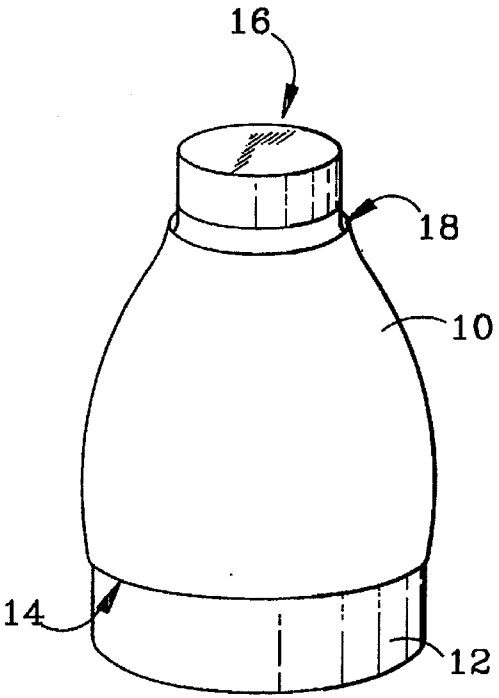
Figure 3A:
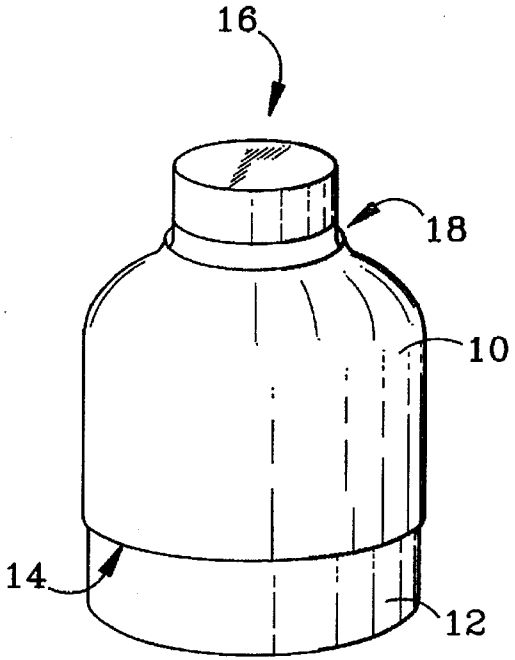

The container's tapered shape keeps it from falling completely through the sleeve's top opening 18. The container 12 must be at least partially tapered for the invention to work. For purposes of the present invention, a container 12 is considered "tapered" if any portion of it is wider than its dispensing end 16. Although the invention is described and illustrated using a generally cone-shaped container 12 and sleeve 10, other shapes and sizes may be used without departing from the scope of the invention, as illustrated in FIGS. 3*a*–3*c*. In FIG. 3*a*, a container 12 and sleeve 10 with a generally oval shape and a relatively short taper is illustrated. In FIG. 3*b*, the container 12 and sleeve 10 have longer taper and have a generally round shape. In FIG. 3*c*, the container is tapered at its dispensing end 16 and at its bottom 22. In all three configurations, the sleeve's bottom portion 14 preferably extends no further than the widest part of the container 12, as explained above.

Referring back to FIG. 2*c*, the height of sleeve 10 and the size of its top opening 18 is preferably chosen so that the dispensing end 16 of its associated container 12 does not contact the support surface 13 in its inverted position. However, the clearance between the container's dispensing end and the support surface is preferably small for increased stability and to restrict the system's overall height. In addition, the size and shape of the sleeve's bottom portion 14 is preferably made approximately equal to that of the widest portion of the container 12 in order to provide a more stable base for the sleeve 10 in its in-use position. The increased stability arises from the resulting increased contact area between the sleeve's bottom portion 14 and the support surface 13, and from the resulting alignment of the centers of gravity of the container 12 and sleeve 10. The sleeve's height, and the size and shape of its bottom portion 14, can be controlled by adjusting how much of the container 12 is covered by the form-fitting sleeve 10 in its non-use or shipping configuration, as illustrated in FIGS. 1 and 3*a*–3*c*.

When the container 12 is in the inverted position, as shown in FIG. 2*c*, its contents will settle to its dispensing end 16 over time. This will allow a consumer to easily dispense the contents of the container 12 without having to shake it. The sleeve 10 may be placed on any convenient flat surface, preferably the place where the container 12 is stored when it is not being used. In the case of a food container, this may be a refrigerator shelf, table, cupboard, or any place where the food container is normally stored. This will allow the container 12 to be stored in an inverted position so that its contents remain settled at its dispensing end 16.

Numerous other variations and alternate embodiments will occur to those skilled in the art without departing from the spirit and scope of the invention. Although the invention was illustrated and described primarily in the context of food containers, it may be applied to containers that are designed to hold non-edible viscous contents, such as creams and lotions. Accordingly, it is intended that the invention be limited only in terms of the appended claims.

We claim:

1. A viscous material storage and dispensing system, comprising:

a container for storing viscous material that includes an upper dispensing end and a lower end that supports the container in an upright position, said container tapering towards its upper end, and an open-ended sleeve that is shaped with a taper that conforms to the container taper and fits snugly over said container in a form-fitting fashion during non-use, said sleeve being removable from the container by lifting it up over the container's upper end, and having a lower end that acts as a base and an upper end shaped to receive and support said container in an inverted position when the sleeve is removed from the container so that said viscous material settles towards said dispensing end when said container is stored in said inverted position, said upper sleeve end extending no higher than the upper end of the container and said lower sleeve end terminating above the lower end of the container when fitted over the container during non-use.

2. The system of claim 1, wherein said sleeve and said container are made of a common material.

3. The system of claim 1, wherein said container comprises a food container.

4. The system of claim 1, wherein the size and shape of the lower end of said sleeve is approximately equal to that of the widest portion of said container.

5. A method of storing and dispensing viscous material, comprising the steps of:

providing said viscous material in a container that includes an upper dispensing end and a lower end that supports the container in an upright position, and that tapers towards its upper end, providing a removable tapered sleeve with open upper and lower ends fitted snugly over said container in a form fitting fashion during non-use, with the upper sleeve end extending no higher than the upper end of the container and the lower sleeve end terminating above the lower end of the container, removing said sleeve from said container by lifting it up over the container's upper end, positioning said sleeve with its lower end on a support surface, inverting said container and inserting its dispensing end through the upper end of said sleeve so that said sleeve supports said container in an inverted position, storing said container in said inverted position to allow said viscous material to flow towards its dispensing end, and removing said container from said sleeve and dispensing said viscous material.

6. The method of claim 5, wherein said sleeve supports said container with its dispensing end spaced above said support surface in said inverted position.

7. The method of claim 5, wherein the size and shape of said sleeve's lower end is approximately equal to that of the widest portion of said container.

* * * * *